US007401604B2

(12) United States Patent
Furukawa et al.

(10) Patent No.: US 7,401,604 B2
(45) Date of Patent: Jul. 22, 2008

(54) ENGINE CONTROL DEVICE AND CONTROL METHOD THEREOF

(75) Inventors: Harumi Furukawa, Iwata (JP); Yoshitsugu Kosugi, Iwata (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/676,887

(22) Filed: Feb. 20, 2007

(65) Prior Publication Data

US 2007/0199552 A1 Aug. 30, 2007

(30) Foreign Application Priority Data

Feb. 24, 2006 (JP) ..... 2006-049146

(51) Int. Cl.
*F02D 41/14* (2006.01)

(52) U.S. Cl. ..... 123/674; 123/480; 701/105

(58) Field of Classification Search ..... 123/674, 123/679, 480, 486; 701/103–105, 108–109
See application file for complete search history.

(56) References Cited

U.S. PATENT DOCUMENTS 4,530,333 A * 7/1985 Nishimura ..... 123/674
4,834,051 A * 5/1989 Tanaka et al. ..... 123/703
4,957,087 A * 9/1990 Ota ..... 123/479

* cited by examiner

*Primary Examiner*—Hieu T Vo
(74) *Attorney, Agent, or Firm*—Hogan & Hartson LLP

(57) ABSTRACT

An engine control device and method that prevents fuel injection quantity from becoming unstable due to a rapid change of a correction quantity even in a predetermined operation state such as acceleration time and thus stabilizes an air-fuel ratio. Under a predetermined operating state, even when feedback control of oxygen in exhaust gas is stopped, a correction quantity immediately before the predetermined operating state is held by a correction quantity storage part and the correction of the fuel injection time is performed based on the correction quantity.

5 Claims, 5 Drawing Sheets

[Fig. 1]
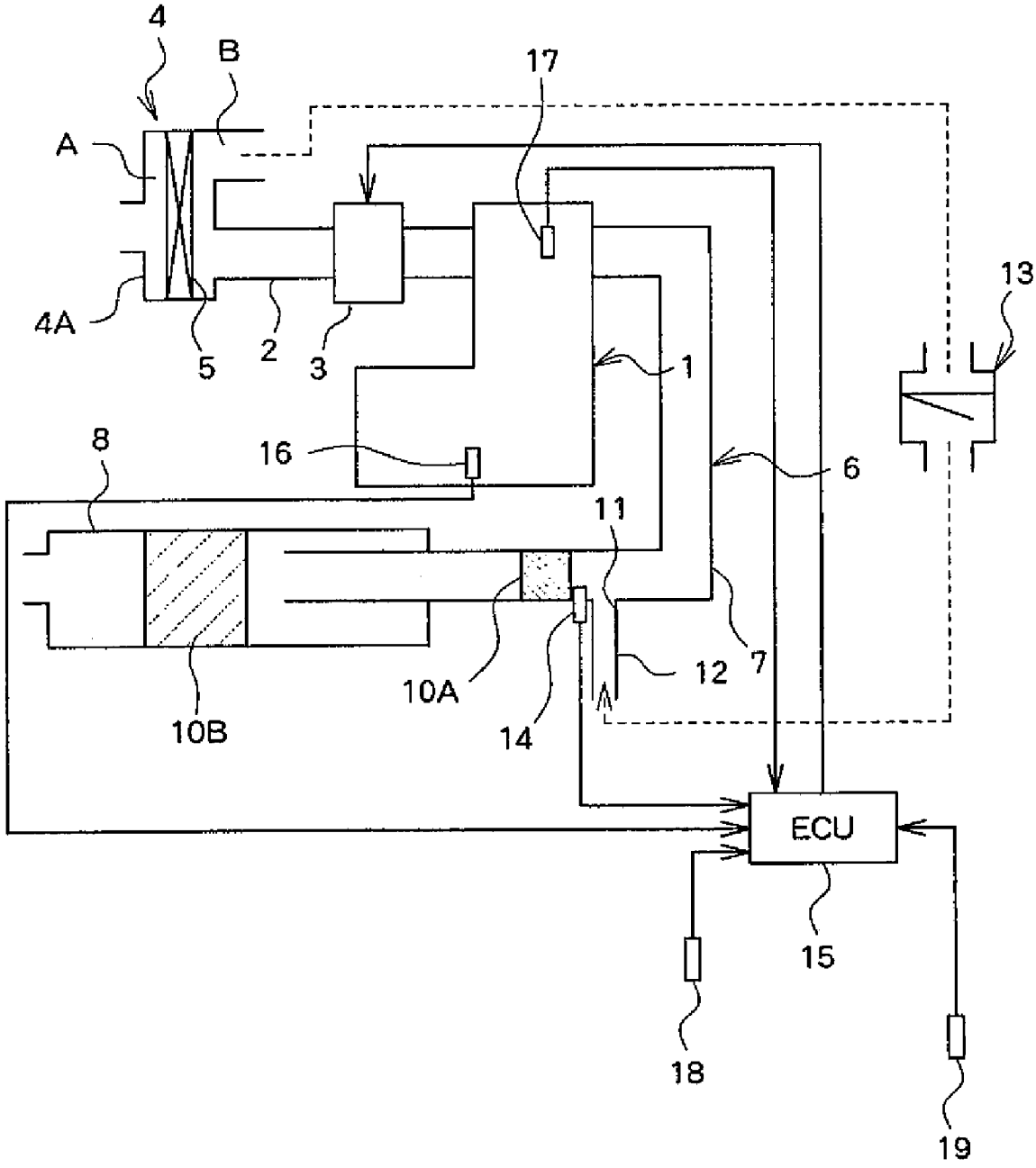

[Fig. 2]
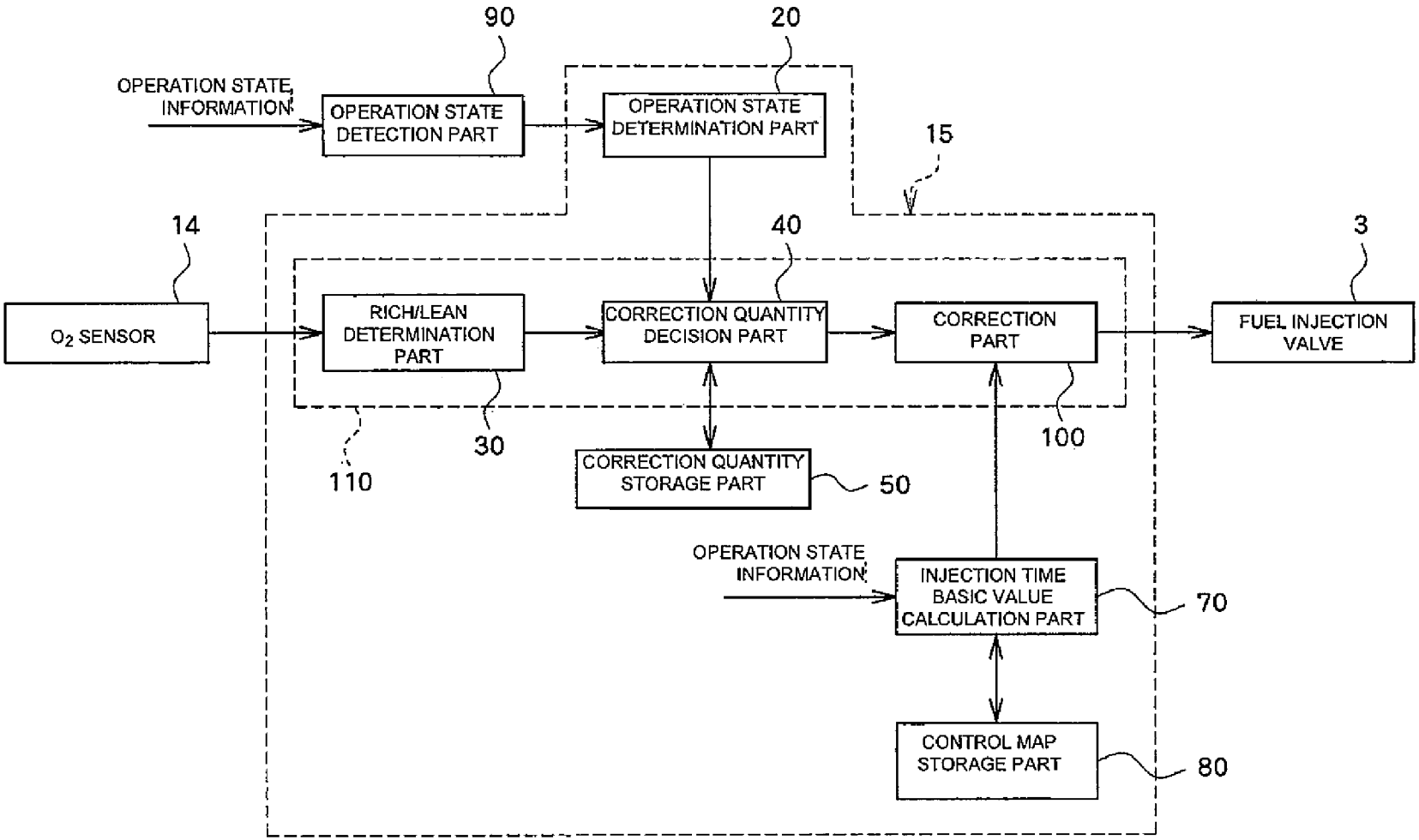

[Fig. 3]
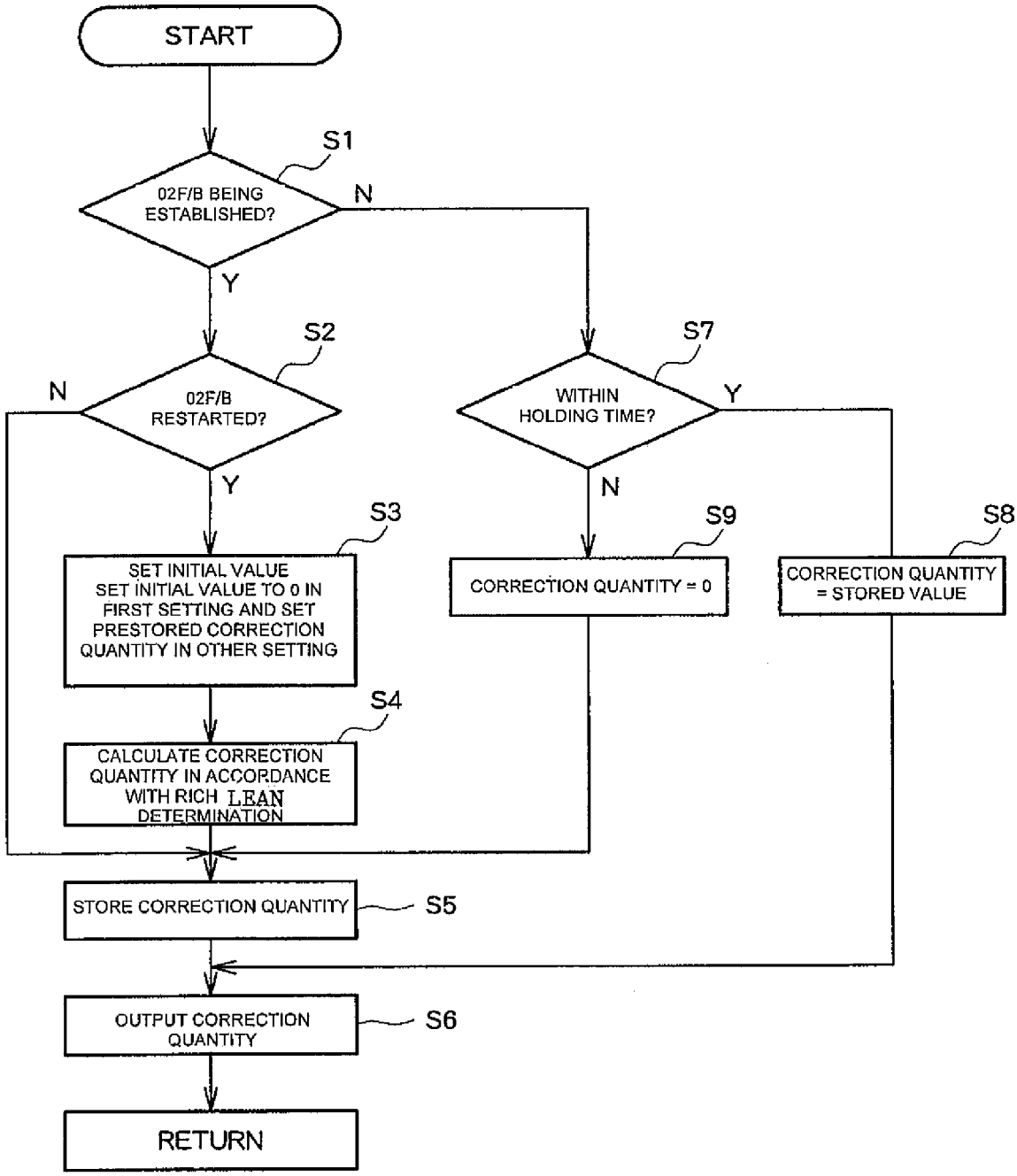

[FIG. 4]
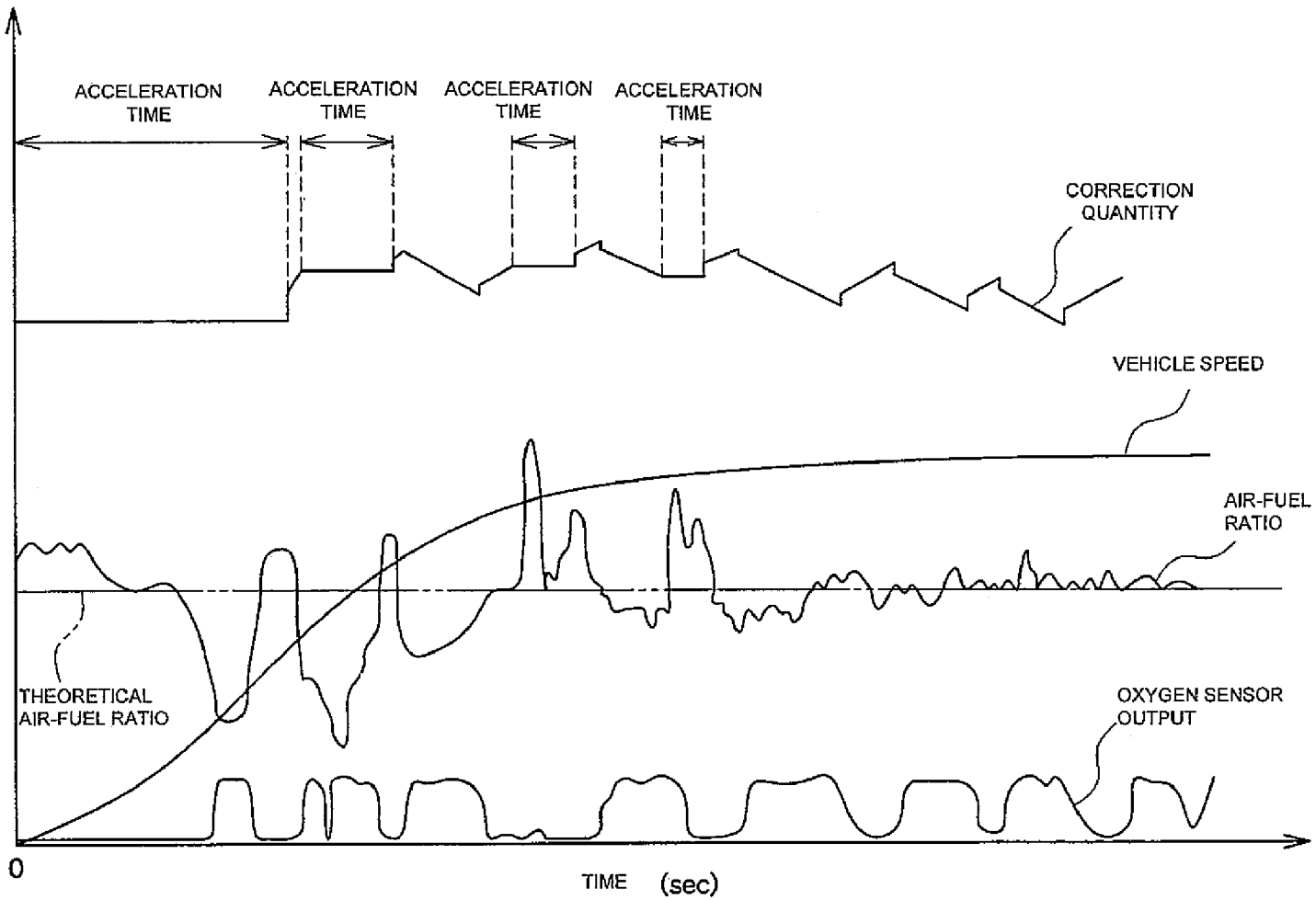

[Fig. 5]
PRIOR ART
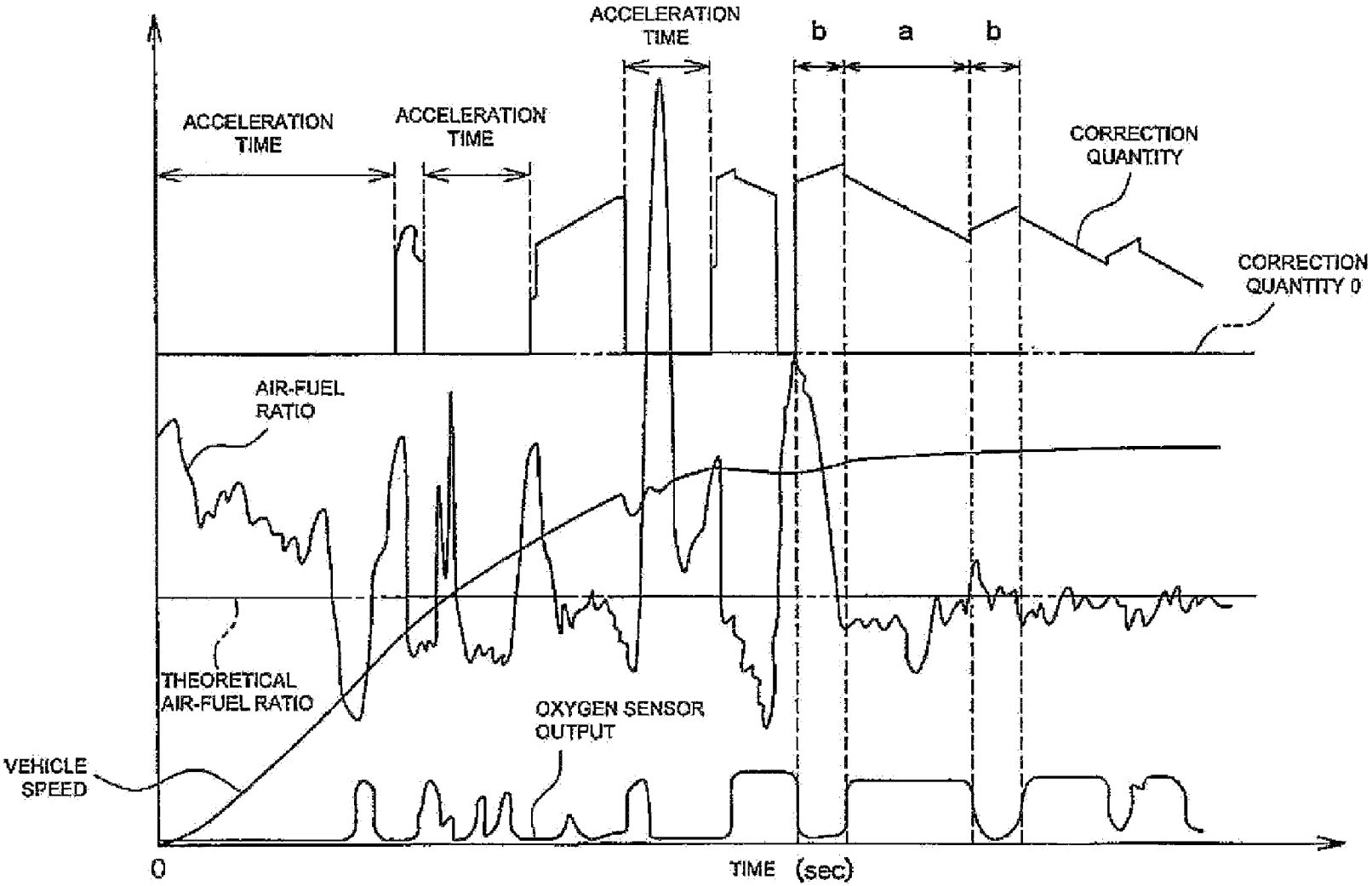

ENGINE CONTROL DEVICE AND CONTROL METHOD THEREOF

RELATED APPLICATIONS

This application claims the benefit of priority under 35 USC 119 of Japanese patent application no. 2006-049146, filed on Feb. 24, 2006, which application is hereby incorporated by reference in its entirety.

BACKGROUND OF THE INVENTION

1. Field of the Invention

This invention relates to an engine control device and method for controlling a ratio of air contained in fuel that is supplied to an engine (air-fuel ratio) based on a measurement result of oxygen density in an exhaust gas from the engine.

2. Description of Related Art

Recently, to reduce harmful contents in exhaust gas and obtain an optimum combustion state, a feedback-control-type engine control device has been proposed that converges an air-fuel ratio inside the engine to a theoretical air-fuel ratio (stoichimetric control). The device detects the density of oxygen in exhaust gas using an oxygen sensor mounted on the exhaust system, and controls the supply quantity of fuel or air based on a correction quantity in response to the detected oxygen density, thus adjusting the air-fuel ratio of the intake air-fuel mixture to a proper air-fuel ratio.

Some such feedback-control-type devices adopt an oxygen feedback-control method such as that shown in FIG. 5. When the air-fuel ratio of the air-fuel mixture in the exhaust gas is shifted to a rich side, as in range "a", the oxygen feedback control reduces the correction quantity to approximate the air-fuel ratio to the theoretical air-fuel ratio. At the same time, when the air-fuel ratio of the air-fuel mixture in the exhaust gas is shifted to a lean side, as in range "b", the oxygen feedback control increases the correction quantity to approximate the air-fuel ratio to the theoretical air-fuel ratio.

In such a prior art engine control device, when oxygen feed back control is performed in a predetermined operation state, such as during acceleration time, engine output tends to be lowered. Accordingly, as shown in FIG. 5, at the time of acceleration, the oxygen feedback control is temporarily stopped by setting the correction quantity to zero, and only a usual control that uses a control map preliminarily stored in the engine control device is performed. However, in this prior art method of oxygen feedback control, there is a drawback in that, at the time of acceleration, the correction quantity is rapidly changed as shown in FIG. 5. This causes the fuel injection quantity to become unstable, which makes it difficult to approximate the intake air-fuel mixture to a target air-fuel ratio.

SUMMARY OF THE INVENTION

The invention addresses these problems and provides an engine control device and method that suppresses rapid change in correction quantity and instability in fuel injection quantity, even in a predetermined operation state such as acceleration time, and thus stabilizes the air-fuel ratio.

An engine control device according to the invention includes an oxygen density detection means that detects an oxygen density in an exhaust gas exhausted from an engine. A fuel injection time calculation means sequentially decides a correction quantity for correcting a fuel injection time for injecting fuel to the engine so as to approximate an air-fuel ratio of the engine to a predetermined value based on the oxygen density detected by the oxygen density detection means, and calculates the fuel injection time for injecting the fuel to the engine based on the correction quantity. A correction quantity storage means stores the correction quantity sequentially decided by the fuel injection time calculation means. The fuel injection time calculation means calculates the fuel injection time based on the correction quantity that is sequentially decided and already stored by the correction quantity storing means when the engine assumes a predetermined operation state.

An engine control method according to the invention includes detecting an oxygen density in an exhaust gas exhausted from an engine, sequentially deciding a correction quantity for correcting a fuel injection time for injecting a fuel to an engine so as to approximate an air-fuel ratio of the engine to a predetermined value based on the oxygen density and calculating the fuel injection time for injecting the fuel to the engine based on the correction quantity, and storing the sequentially-decided correction quantity in a storing means. The fuel injection time is calculated based on the correction quantity that is sequentially determined and already stored by the storing means when the engine assumes a predetermined operation state.

According to the invention, in accelerating the engine, even when feedback control of oxygen in the exhaust gas is stopped, the correction quantity immediately before acceleration is held by the storage means and correction of the fuel injection time can be performed for a fixed time based on the correction quantity.

Further, according to one mode of the invention, the fuel injection time calculation means includes a rich/lean determination means that sequentially determines whether the engine is driven in a rich state or in a lean state based on the oxygen density detected by the oxygen density detection means, and a correction quantity determination means that sequentially determines the correction quantity corresponding to a determination result of the rich/lean determination means so as to approximate the air-fuel ratio of the engine to the predetermined value.

Further, according to another mode of the invention, the control device includes an operation state detection means that detects an operation state of the engine, and an injection-time basic-value calculation means that calculates a basic value of the fuel injection time for injecting fuel to the engine based on the operation state of the engine, wherein the fuel injection time calculation means calculates the fuel injection time based on the basic value calculated by the injection-time basic-value calculation means and the correction quantity.

The operation state detection means may include a crank angle sensor that detects a rotational speed of the engine, and an intake pressure sensor that detects an intake pressure of an air-fuel mixture in the engine.

According to the invention, in accelerating the engine, even when feedback control of oxygen in the exhaust gas is stopped, the correction quantity immediately before acceleration is held by the storage means and the correction of the fuel injection time is performed for the fixed time based on the correction quantity. Accordingly, the air-fuel ratio is approximated to the target air-fuel ratio and stabilized by suppressing rapid change of the correction quantity, thus stabilizing injection of fuel into the engine.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is a schematic diagram of an engine control device according to the invention.

FIG. 2 is a block diagram of the engine control device according to the invention.

FIG. 3 is a flowchart showing a correction quantity decision process of the engine control device according to the invention.

FIG. 4 is a characteristic diagram showing oxygen sensor output, vehicle speed and correction quantity of the engine control device according to the invention.

FIG. 5 is a characteristic diagram showing oxygen sensor output, vehicle speed and correction quantity of an engine control device of the related art.

DETAILED DESCRIPTION OF THE INVENTION

An engine control device according to an embodiment of the invention as applied to a motorcycle is explained in conjunction with FIGS. 1-4.

In FIG. 1, numeral 1 indicates an engine that is mounted on a motorcycle. A fuel injection valve 3 injects and supplies fuel to an intake port of an intake passage 2 of engine 1. An air cleaner 4 is connected to an upstream end of intake passage 2. Air cleaner 4 separates the inside of a cleaner casing 4A into an air intake side A and an air discharge side B using an element 5.

An exhaust device 6 that discharges exhaust gas to the outside is connected to an exhaust port of engine 1. Exhaust device 6 includes an exhaust pipe 7 connected to the exhaust port and a muffler 8 connected to a downstream end of exhaust pipe 7. An exhaust gas purifying device mounted on exhaust device 6 is configured such that three-dimensional catalysts 10A, 10B are arranged in both of or either one of exhaust pipe 7 and muffler 8 (in this embodiment, both of exhaust pipe 7 and muffler 8). A secondary air inlet port 11 is provided to exhaust pipe 7 upstream of three-dimensional catalysts 10A,B and a secondary air introduction system is connected to inlet port 11. The secondary air introduction system is configured such that air discharge side B of air cleaner 4 and secondary air inlet port 11 are communicably connected by a secondary air introduction pipe 12. A lead valve 13 that functions as a check valve is interposed in a middle portion of secondary air introduction pipe 12.

An oxygen sensor 14 which constitutes an oxygen density detection means is mounted on exhaust pipe 7 upstream of three-dimensional catalyst 10A and is connected to a controller 15. Oxygen sensor 14 detects the density of oxygen contained in exhaust gas discharged from engine 1.

A crank angle sensor 16 that detects a crank angle of a crank shaft for reciprocating a piston inside engine 1 and an engine rotational speed is mounted on engine 1. An intake pressure sensor 17 for detecting an intake pressure of an air-fuel mixture supplied to engine 1 is mounted on engine 1. Crank angle sensor 16 and intake pressure sensor 17 are connected to controller 15. A throttle sensor 18 for detecting the degree of opening of a throttle is mounted on a throttle side of the motorcycle, while a vehicle speed sensor 19 is mounted on the motorcycle. Throttle sensor 18 and vehicle speed sensor 19 are connected to controller 15. Sensors 16-19 (crank angle sensor 16, intake pressure sensor 17, throttle sensor 18 and vehicle speed sensor 19) constitute an operation state detection part 90 for detecting operation state information of the motorcycle (see FIG. 2).

A control device of engine 1 is now explained in conjunction with FIG. 2. Controller 15 of the control device of engine 1 comprises a microcomputer and control software, and includes an operation state determination part 20, a rich/lean determination part 30 that constitutes a rich/lean determination means, a correction quantity decision part 40 that constitutes a correction quantity decision means, a correction quantity storage part 50, an injection time basic value calculation part 70 that constitutes an injection time basic value calculation means, a control map storage part 80 and a correction part 100.

Operation state determination part 20 determines whether the motorcycle is in an operation state such as acceleration based on operation state information detected by operation state detection part 90 (sensors 16-19), and outputs determination signals to correction quantity decision part 40.

Rich/lean determination part 30 sequentially determines whether engine 1 is operated with the exhaust gas in a rich or lean state based on the oxygen density detected by oxygen sensor 14. That is, rich/lean determination part 30 sequentially determines whether carbon monoxide (CO), carbon hydroxide (HC) and the like (hereinafter referred to as harmful contents) are increased in the exhaust gas so that oxygen is short (a rich state) or are decreased so that oxygen is excessive (a lean state).

Correction quantity decision part 40, in a usual operation state (an operation state other than predetermined operation states such as acceleration), sequentially decides the correction quantity such that the air-fuel ratio of engine 1 approximates a theoretical air-fuel ratio (stoichimetric control), which is a predetermined value corresponding to a determination result of rich/lean determination part 30, and outputs the correction quantity to correction part 100 at a rear stage. At the same time, decision part 40 makes correction quantity storage part 50 store the correction quantity. In this manner, in the usual operation state, oxygen feedback control is performed. Thus, rich/lean determination part 30 determines that the current air-fuel ratio is in a rich state, correction quantity decision part 40 subtracts a predetermined value (for example, one) from the correction quantity stored in correction quantity storage part 50 and outputs the value to correction part 100 as a new correction quantity. Then, the correction quantity stored in correction quantity storage part 50 is updated with this value. When rich/lean determination part 30 determines that the current air-fuel ratio is in a lean state, correction quantity decision part 40 adds a predetermined value (for example, one) to the correction quantity stored in correction quantity storage part 50 and outputs the value to correction part 100 as a new correction quantity. Then, the correction quantity stored in correction quantity storage part 50 is updated with this value. Correction quantity storage part 50 stores zero at the time of starting engine 1. Further, in a predetermined operation state such as acceleration that continues for a predetermined time (holding time), the correction quantity is updated to zero.

On the other hand, correction quantity decision part 40, in a predetermined operation state such as acceleration, stops the above-described oxygen feedback control and directly outputs the correction quantity stored in correction quantity storage part 50 to the correction part 100 without modification. When the predetermined operation state such as acceleration continues for the predetermined (holding) time, zero is stored in the correction quantity storage part as the correction quantity and, at the same time, zero is outputted to correction part 100.

Correction quantity decision part 40, rich/lean determination part 30 and correction part 100 constitute a fuel injection time calculation part 110 that sequentially decides, based on the oxygen density detected by oxygen sensor 14, the correction quantity that corrects the fuel injection time for injecting fuel to engine 1 such that the air-fuel ratio of engine 1 approximates the theoretical air-fuel ratio and, at the same time, calculates the fuel injection time for injecting fuel to engine 1 based on the correction quantity.

Correction quantity storage part 50 stores the correction quantity for correcting the fuel injection time for injecting fuel to engine 1 that is calculated by correction quantity decision part 40, that is, the correction quantity that is sequentially decided by correction quantity decision part 40, wherein the value of the correction quantity is suitably read by correction quantity decision part 40 or is suitably written in correction quantity decision part 40.

Injection time basic value calculation part 70 calculates a basic value of the fuel injection time for injecting fuel to engine 1 based on operation state information detected by sensors 16-19 and a control map stored in control map storage part 80. That is, the control map correlates operation state information detected by sensors 16-19 and the basic value of the fuel injection time for injecting fuel to engine 1. Injection time basic value calculation part 70, upon acquisition of the operation state information, reads out the basic value stored in the control map in a correlating manner with the operation state information and supplies the basic value to correction part 100.

Correction part 100 calculates the fuel injection time for injecting fuel to engine 1 based on the above-mentioned basic value calculated by injection time basic value calculation part 70 and the correction quantity outputted from correction quantity decision part 40, and controls the time that fuel is injected from fuel injection valve 3. That is, correction part 100 calculates (by multiplication, for example) the fuel injection time such that it is prolonged corresponding to the increase of the correction quantity and is shortened corresponding to the decrease of the correction quantity using the basic value and the correction quantity.

Operation of correction quantity decision part 40 is now explained in conjunction with FIG. 3. The control shown in FIG. 3 is executed for every predetermined control cycle.

In step S1, operation state determination part 20 determines whether an operation state of the motorcycle is in a predetermined state such as acceleration (whether oxygen feedback is being established or not). When the operation state is not in the predetermined state (YES), processing advances to step S2. When the operation state is in the predetermined state (NO), processing advances to step S7.

Step S2 determines whether oxygen feedback is restarted. That is, operation state determination part 20 determines whether the start condition of the feedback control is re-established (whether the operation state that is in the usual state in the preceding control cycle again assumes the predetermined state in the current control cycle). When oxygen feedback is started again (YES), processing proceeds to step S3. When oxygen feedback is not started again (NO), processing advances to step S4.

In step S3, an initial value of the correction quantity is set and processing advances to step S4. Zero is firstly set as the initial value of the correction quantity (for example, at the time of starting), while the correction quantity stored in correction quantity storage part 50 in step S5 is set as an initial value of the correction factor in other conditions.

In step S4, the correction quantity is calculated in response to the determination signal inputted to correction quantity decision part 40 from rich/lean determination part 30, and processing advances to step S5. In step S5, the calculated correction quantity is stored in correction quantity storage part 50. In step S6, the correction quantity stored in step S5 is outputted to correction quantity part 100 and processing returns to step S1 and is repeated.

On the other hand, in step S7, it is determined whether the predetermined operation state is continued for the predetermined holding time. When the holding time is not yet elapsed (YES), processing advances to step S8 and a stored value of correction quantity storage part 50 is outputted as the correction quantity to correction part 100 in step S6. When the holding time elapses (NO), processing advances to step S9 and the correction quantity is set to zero and, at the same time, the value is stored in correction storage part 50 in step S5. Then, the stored correction quantity (zero) is outputted to correction part 100.

According to the engine control device of the invention, as shown in FIG. 4, at the time of acceleration, even when feedback control of oxygen in the exhaust gas discharged from exhaust pipe 7 is stopped, the correction quantity immediately before the acceleration is held in correction quantity storage part 50, and the correction of the fuel injection time can be performed for a fixed time based on the correction quantity. Accordingly, rapid changes of correction quantity are suppressed and hence, the air-fuel ratio is approximated to the target air-fuel ratio. The air-fuel ratio is thus stabilized and stable injection of fuel into engine 1 can be performed.

Although the predetermined operation state has been described as the acceleration time, the invention is not so limited and may be applicable to other operation states such as, for example, idling time, gear change time, high-load operation time and the like.

The particular embodiments of the invention described in this document should be considered illustrative, rather than restrictive. Modification to the described embodiments may be made without departing from the spirit of the invention as defined by the following claims.

The invention claimed is:

1. An engine control device comprising:

an oxygen density detection means for detecting an oxygen density in an exhaust gas exhausted from an engine;

a fuel injection time calculation means for calculating fuel injection time that sequentially decides a correction quantity for correcting a fuel injection time for injecting fuel to the engine so as to approximate an air-fuel ratio of the engine to a predetermined value based on the oxygen density detected by the oxygen density detection means for detecting, and calculates the fuel injection time for injecting the fuel to the engine based on the correction quantity; and a correction quantity storage means for storing the correction quantity sequentially decided by the fuel injection time calculation means for calculating, wherein the fuel injection time calculation means for calculating calculates the fuel injection time based on the correction quantity that is sequentially decided and is already stored by the correction quantity storing means for storing when the engine assumes a predetermined operation state.

2. An engine control device according to claim 1, wherein the fuel injection time calculation means for calculating includes a rich/lean determination means for determining states that sequentially determines whether the engine is driven in a rich state or in a lean state based on the oxygen density detected by the oxygen density detection means for detecting, and a correction quantity determination means for determining that sequentially determines the correction quantity corresponding to a determination result of the rich/lean determination means for determining so as to approximate the air-fuel ratio of the engine to the predetermined value.

3. An engine control device according to claim 1, further comprising:

an operation state detection means for detecting an operation state of the engine, and an injection-time basic-value calculation means for calculating a basic value of the fuel injection time for injecting the fuel to the engine based on the operation state of the engine, and the fuel injection time calculation means for calculating calculates the fuel injection time for injecting the fuel to the engine based on the basic value calculated by the injection-time basic-value calculation means for calculating the correction quantity.

4. An engine control device according to claim 3, wherein the operation state detection means for detecting comprises:

a crank angle sensor that detects a rotational speed of the engine, and an intake pressure sensor that detects an intake pressure of an air-fuel mixture into the engine.

5. An engine control method comprising:

detecting an oxygen density in an exhaust gas exhausted from an engine;

sequentially deciding a correction quantity for correcting a fuel injection time for injecting a fuel to an engine so as to approximate an air-fuel ratio of the engine to a predetermined value based on the oxygen density and calculating the fuel injection time for injecting the fuel to the engine based on the correction quantity; and storing the sequentially-decided correction quantity in a storing means for storing, wherein the fuel injection time is calculated based on the correction quantity that is sequentially determined and is already stored by the storing means for storing when the engine assumes a predetermined operation state.

* * * * *